US007287980B2

(12) United States Patent
Nurmi

(10) Patent No.: US 7,287,980 B2
(45) Date of Patent: Oct. 30, 2007

(54) TON UNIT HEATING SADDLE

(75) Inventor: Douglas B. Nurmi, McKinney, TX (US)

(73) Assignee: Air Liquide Electronics U.S. LP, Houston, TX (US)

( * ) Notice: Subject to any disclaimer, the term of this patent is extended or adjusted under 35 U.S.C. 154(b) by 0 days.

(21) Appl. No.: 11/427,275

(22) Filed: Jun. 28, 2006

(65) Prior Publication Data

US 2007/0003898 A1 Jan. 4, 2007

Related U.S. Application Data

(60) Provisional application No. 60/695,585, filed on Jun. 30, 2005.

(51) Int. Cl.
*F24H 7/02* (2006.01)

(52) U.S. Cl. ..... 432/17; 220/560.11; 219/521; 219/429; 219/436

(58) Field of Classification Search ..... 432/17, 432/29, 30; 220/560.11, 581, 901; 141/18, 141/20; 219/521, 385, 536, 429, 430, 433, 219/436

See application file for complete search history.

(56) References Cited

U.S. PATENT DOCUMENTS 3,753,407 A * 8/1973 Tilseth ..... 108/53.3
5,267,648 A * 12/1993 Baker ..... 206/446
5,549,339 A * 8/1996 Frean ..... 294/31.2
5,853,289 A * 12/1998 Todd et al. ..... 432/225
6,025,576 A * 2/2000 Beck et al. ..... 219/521
6,433,316 B1 * 8/2002 Sigety et al. ..... 219/433
6,561,797 B1 * 5/2003 Johnson ..... 432/225
6,581,412 B2 * 6/2003 Pant et al. ..... 62/657
6,614,009 B2 * 9/2003 Gershtein et al. ..... 219/486

OTHER PUBLICATIONS

MX4F5KW, Installation and Operating Manual, 33003A, "MegaFlow 4x5KW", Accurate Gas Control Systems, pp. 1-26.

* cited by examiner

*Primary Examiner*—Gregory Wilson
(74) *Attorney, Agent, or Firm*—Brandon Clark

(57) ABSTRACT

Embodiments of the invention provide methods, systems, and apparatus for delivering gas in a liquefied state at a controlled rate. The liquefied gas may be transported in ton cylinders by placing the ton cylinder on a transportation pallet. The transportation pallet containing the ton cylinder may be placed on a heating saddle so that a surface of the cylinder is in contact with a surface of the heating saddle. Heating fluid may flow through the heating saddle, thereby heating the liquid in the cylinder through the cylinder walls. Furthermore, the vapor pressure of the gas in the cylinder may be monitored and maintained at a desired level by regulating the flow of heating fluid through the saddle. Therefore, embodiments of the invention allow the maintenance of gas flow rates in a cylinder without removing the cylinder from its transportation pallet.

19 Claims, 5 Drawing Sheets

TON UNIT HEATING SADDLE

CROSS REFERENCE TO RELATED APPLICATIONS

This application claims the benefit under 35 U.S.C. § 119(e) to provisional application No. 60/695,585, filed Jun. 30, 2005, the entire contents of which are incorporated herein by reference.

BACKGROUND

1. Field of the Invention

The present invention relates to a system for delivering gas from a liquefied state, and more specifically to delivering the gas at a controlled rate.

2. Description of the Related Art

Several manufacturing industries require the use of high purity, corrosive, liquefied gases to perform various manufacturing steps. For example, a reliable supply of ultra high purity electronic specialty gases is critical to maintaining productivity and manufacturing yield in the semiconductor industry. Exemplary semiconductor fabrication processes that require high purity gases include diffusion, chemical vapor deposition (CVD), etching, sputtering, ion implantation, etc.

Because some gases may be highly toxic and corrosive the gases may be contained carbon steel containers in a liquefied form. The carbon steel containers are typically gas cylinders that are configured to contain and deliver the high pressure gases in a safe manner.

Manufacturing processes may require that the gases be provided in a controlled manner at a determined flow rate. One problem with providing gases from cylinders is that the temperature of the liquefied gas may decrease with time. The temperature drop in the liquid may decrease the vapor pressure of the gas. The dropping vapor pressure may adversely affect the rate of gas flow from the cylinder.

One solution to maintaining gas flow rates is to heat the cylinders, thereby maintaining the temperature and vapor pressure in the cylinder at a desired level. Heating the cylinders usually involves placing the cylinder in a tub-shaped unit containing heating elements. The heating elements may input heat into the cylinder through the cylinder walls. However, such solutions require hoisting the cylinder from its transportation pallet to place the cylinder in a heating tub. The large size and weight of the cylinder may make such hoisting very tedious. Furthermore, because the cylinders typically contain toxic gases such as ammonia, the hoisting of the cylinder may increase the risk of dropping and damaging the cylinder, which may result in the leakage of the toxic gases.

Other prior art solutions include induction heating of the cylinder by wrapping a heating coil or heating jacket around the cylinder. However, such heating jackets have proven to be thermally inefficient.

Accordingly, what is needed are improved methods, systems, and apparatus for safely and efficiently providing liquefied gases at a controlled rate.

SUMMARY

Embodiments of the invention generally provide methods, systems, and apparatus for delivering gas from a liquefied state, and more specifically to delivering the gas at a controlled rate.

One embodiment of the invention provides a method for controlling the gas flow rate from a ton cylinder. The method generally comprises placing the ton cylinder along with a transportation pallet for the ton cylinder on a heating saddle, wherein a surface of the ton cylinder makes contact with a surface of the heating saddle, and circulating a heating fluid through one or more channels in the heating saddle wherein the heating fluid heats the saddle and the heated heating saddle heats a liquified gas in the ton cylinder through the surface of the ton cylinder in contact with the surface of the heating saddle.

Another embodiment of the invention provides a heating saddle. The heating saddle generally comprises a surface for receiving a ton cylinder, wherein the surface makes contact with a surface of the ton cylinder, the ton cylinder being secured to a transportation pallet associated with the ton cylinder, one or more channels in the body of the heating saddle for circulating a heating fluid to heat the heating saddle, and one or more taps, wherein the taps provide an interface between the channels and a heater configured to provide the heating fluids to the heating saddle.

Yet another embodiment of the invention provides a system for controlling the gas flow rate from a ton cylinder. The system generally comprises a heating saddle, a heater for providing a heating liquid, and a control valve for controlling the flow of heating liquid from the heater to the heating saddle. The heating saddle generally comprises a surface for receiving a ton cylinder, wherein the surface makes contact with a surface of a ton cylinder, the ton cylinder being secured to a transportation pallet associated with the ton cylinder, one or more channels in the body of the heating saddle for circulating the heating fluid, wherein the heating liquid heats the heating saddle, and one or more taps, wherein the taps provide an interface for receiving the heating fluid.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF PREFERRED EMBODIMENTS

Embodiments of the invention provide methods, systems, and apparatus for delivering gas in a liquefied state at a controlled rate. The liquefied gas may be transported in ton cylinders by placing the ton cylinder on a transportation pallet. The transportation pallet containing the ton cylinder may be placed on a heating saddle so that a surface of the cylinder is in contact with a surface of the heating saddle. Heating fluid may flow through the heating saddle, thereby heating the liquid in the cylinder through the cylinder walls. Furthermore, the vapor pressure of the gas in the cylinder may be monitored and maintained at a desired level by regulating the flow of heating fluid through the saddle. Therefore, embodiments of the invention allow the maintenance of gas flow rates in a cylinder without removing the cylinder from its transportation pallet.

In the following, reference is made to embodiments of the invention. However, it should be understood that the invention is not limited to the specifically described embodiments. Instead, any combination of the following features and elements, whether related to different embodiments or not, is contemplated to implement and practice the invention. Furthermore, in various embodiments the invention provides numerous advantages over the prior art. However, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Figure 1:
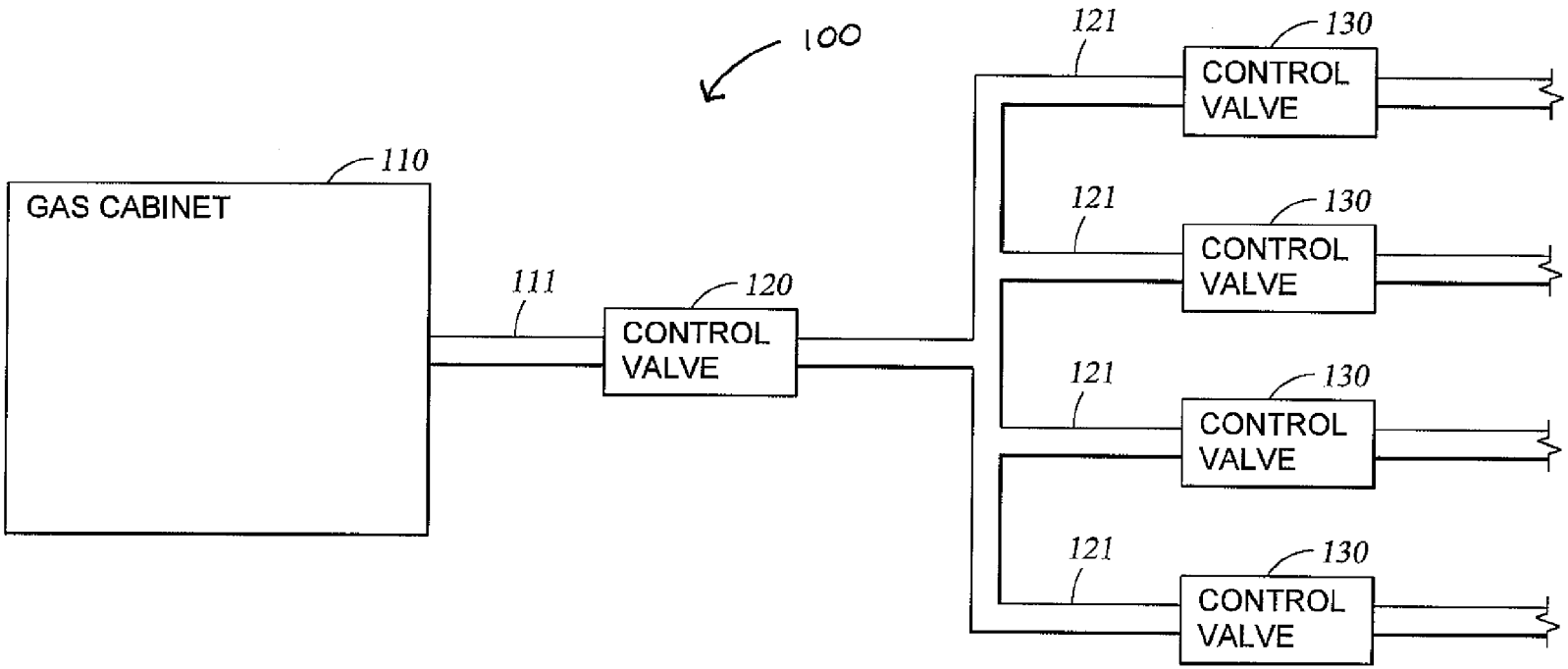
FIG. 1 illustrates an exemplary gas delivery system according to an embodiment of the invention.

FIG. 1 illustrates an exemplary gas delivery system 100 in which embodiments of the invention may be implemented. As illustrated, system 100 may include a gas cabinet 110 connected to a gas line 111 to withdraw gas from the gas cabinet. A control valve 120 may regulate the flow of gas through gas line 111. Gas line 111 may provide the gas from the gas cabinet to a plurality of gas lines 121 if control valve 120 is open. Each of the gas lines 121 may have its own respective control valve 130 to regulate the flow of gas through gas lines 121, as illustrated. Each gas line 121 may provide gas for use in a particular manufacturing step.

Each of valves 121 and valve 111 may be flow control valves that may respond to independent devices such as flow meters, temperature gauges and the like. Valves 121 and 111 may be fitted with actuators that may adjust the flow of gas through a respective gas line based on input from an independent device. In one embodiment, the control valves may be automatic flow control valves that may be configured to regulate the flow of gas through the gas lines based on a property of the gas flowing through a respective gas line.

Gas cabinet 110 may house one or more gas cylinders. The primary purpose of the gas cabinet is to provide a safe vehicle for delivering gases from the cylinders to a process tool in a manufacturing step. The gas cabinet may include various flow control devices such as valves in a configuration allowing cylinder changes and/or component replacement in a safe manner.

Gas cabinet 110 may include a system for purging the gas delivery system in case a leak develops in the cylinders. Purging systems are well known to those skilled in the art. Furthermore, different purging systems may be required for different gases. Therefore, the purging system employed for a particular gas cabinet may depend on the type of liquefied gases provided by the cabinet.

Those skilled in the art will recognize that the gas delivery system illustrated in FIG. 1 is one of many possible configurations for a gas delivery system for delivering high purity gases. Any reasonable modification to the design illustrated in FIG. 1 can be provided that is within the scope of the invention. For example, a plurality of gas cabinets may be connected to a network of gas lines. Furthermore, any reasonable configuration of a hierarchy of gas lines, and any reasonable number and placement of gas valves are within the scope of the invention.

Figure 2:
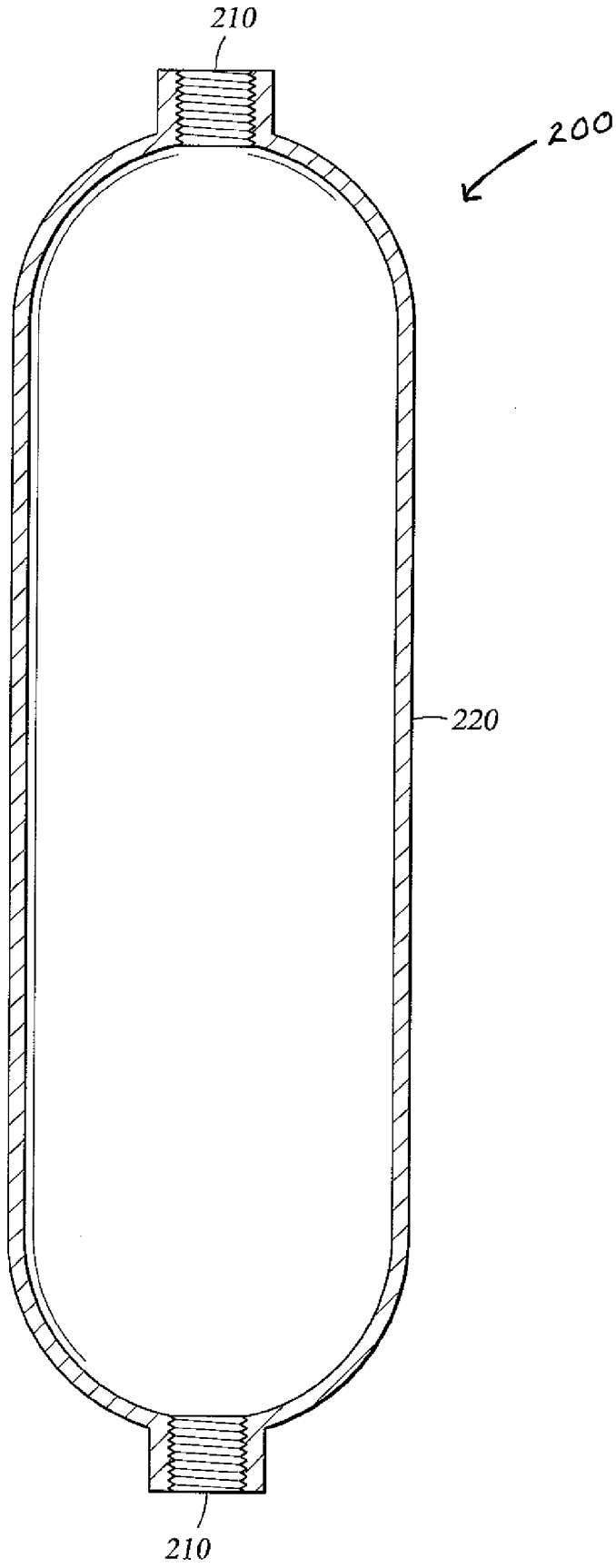
FIG. 2 illustrates an exemplary ton cylinder according to an embodiment of the invention.

FIG. 2 illustrates an exemplary ton cylinder 200 that may be placed in a gas cabinet 110. Gas cylinders, such as ton cylinder 200 may be constructed from steel. For example, ton cylinder 200 may be constructed from steel listed in USDOT specification 3AA, such as Types 4130, NE8630, 9115, 9125, carbon boron steel, intermediate manganese steel, and the like. As illustrated, ton cylinder 200 may contain a threaded opening 210 at each end of the cylinder for insertion of a gas valve. While the threads are shown on the inner surface of the opening 210, one skilled in the art will recognize that the threads may also be located on the outer surface.

Ton cylinder 200 may be configured to store large quantities of high purity, corrosive gases in a liquefied form. For example, ton cylinder 200 may be configured to store ammonia, chlorine, hydrogen chloride, and like gases. One skilled in the art will recognize that a liquefied form of storage may be preferred because much larger quantities of gas may be transported in the cylinder in liquid form rather than gaseous form. In one embodiment of the invention, ton cylinder 200 may have a diameter of around 2 feet, a length of around 6.5 feet and may hold around 600 lbs. of liquefied gas.

Figure 3A:
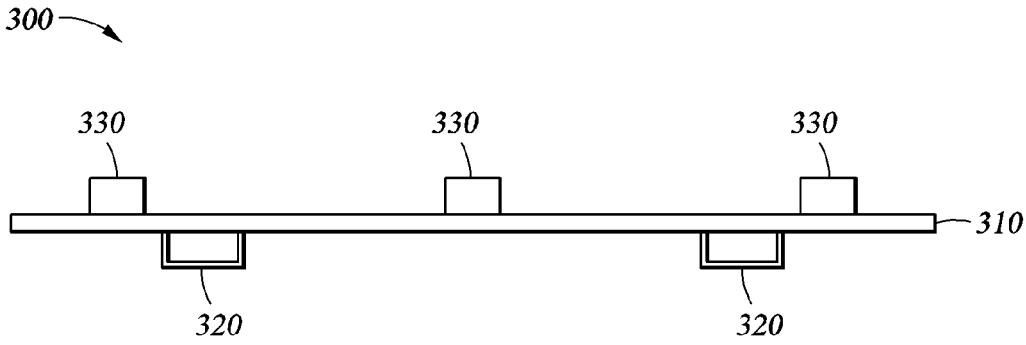
FIGS. 3A and 3B illustrate an exemplary transportation pallet according to an embodiment of the invention.
Figure 3B:
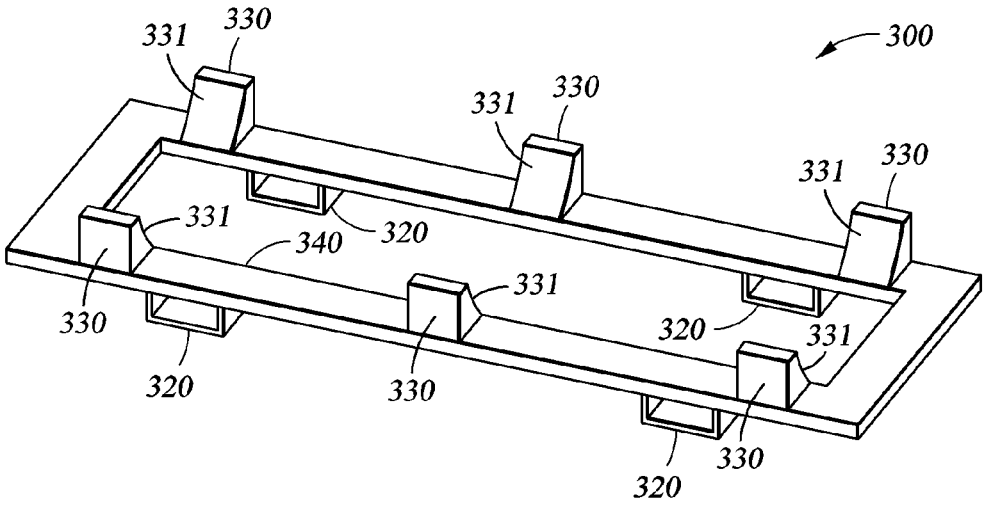

Ton cylinder 200 may be placed on one or more transportation pallets to secure the cylinder during transport. FIGS. 3A and 3B illustrate an exemplary transportation pallet 300 according to an embodiment of the invention. As illustrated in FIG. 3A, pallet 300 may include a frame 310, a plurality of fork lift sleeves 320, and a plurality of cylinder securing devices 330.

FIG. 3B illustrates a top view of transportation pallet 300. As illustrated, cylinder securing devices 330 may include a curved surface 331. The contours of curved surface 331 may match the contours of the circumference of a cylinder 200 to secure the cylinder on the transportation pallet. Transportation pallet 300 may also include an opening 340. When placed on the transportation pallet, a surface of ton cylinder 200, for example surface 220 illustrated in FIG. 2, may be exposed through opening 340.

Fork lift sleeves 320 may be sufficiently large to receive the fingers of a fork lift. During transportation, a cylinder 200 may be placed horizontally and secured on pallet 300. A fork lift may be used to move the pallet containing the cylinder. The pallet containing the cylinder may be placed in a transport vehicle to transport the cylinder to a desired location, for example, a manufacturing facility.

Upon arrival at the destination, a fork lift may be used to remove the pallet containing the cylinder from the transport vehicle. The pallet containing the ton cylinder may then be placed on a heating saddle. The heating saddle may be configured to provide heat to the ton cylinder through the walls of the cylinder. Accordingly, transportation pallet 300 and the heating saddle may be designed in a manner to allow the transportation pallet to fit over a heating saddle so that a surface of ton cylinder 200 makes contact with a surface of the heating saddle.

Figure 4A:
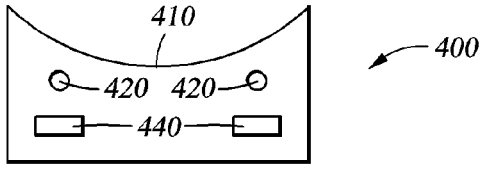
FIGS. 4A-4C illustrate an exemplary heating saddle according to an embodiment of the invention.
Figure 4B:
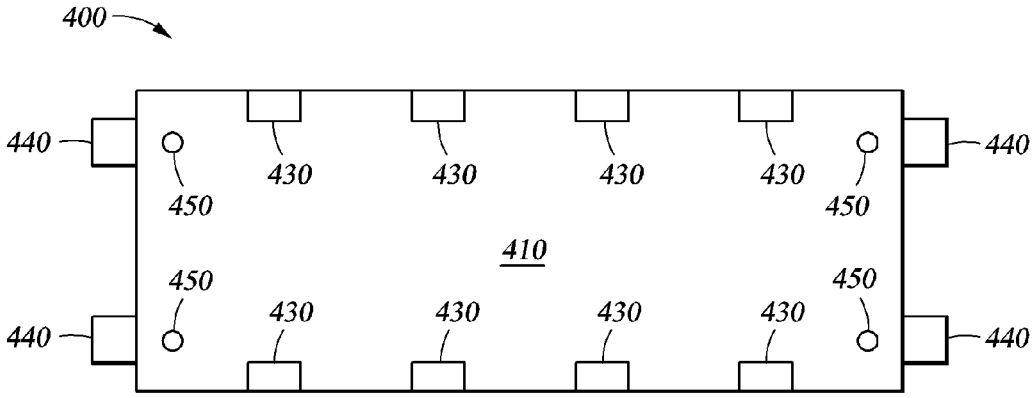
Figure 4C:
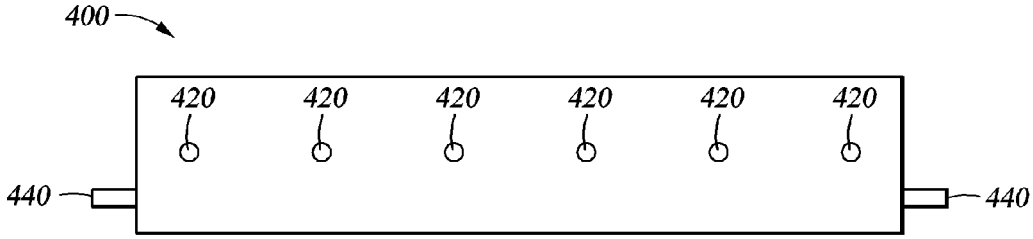

FIGS. 4A-4C illustrate an exemplary heating saddle 400 according to an embodiment of the invention. In one embodiment, heating saddle 400 may be made from a single block that is machined to create a resting surface for a cylinder 200. In a preferred embodiment, heating saddle 400 may be made from a block of steel, however, one skilled in the art will recognize that heating saddle 400 may be made from any suitable material capable of delivering heat to a cylinder 200 placed on heating saddle 400 through a surface of the heating saddle that is in contact with a surface of the cylinder.

FIG. 4A illustrates a profile view of the width of heating saddle 400. As illustrated in FIG. 4A, heating saddle 400 may contain a curved surface 410. The contours of curved surface 410 may be configured to wrap around the contours of the circumference along a surface 220 of cylinder 200. By providing a curved surface matching the curved surface of a cylinder, heating saddle 400 may be in contact with a greater surface area of the cylinder for providing heat. FIG. 4B illustrates a top view of heating saddle 400. As illustrated, curved surface 410 may include a plurality of baffles 430. Baffles 430 may be configured to further secure the cylinder on saddle 400 by preventing the movement of the cylinder.

Heating saddle 400 may also include a holding device 440 on which a transportation pallet 300 may rest. For example, a fork lift may lower a transportation pallet containing a cylinder onto the holding device so that a portion of the transportation pallet rests on the holding device. Heating saddle 400 and transportation pallet 300 may contain one or more locating features to guide the transportation pallet and cylinder into a desired position on the heating saddle. For example, a plurality of recesses and protrusions may be provided on the heating saddle and the transportation pallet, wherein each protrusion locks into an associated recess to position the transportation pallet on the saddle.

Placing the transportation pallet on the holding device may cause a portion of curved surface 220 of cylinder 200 to contact curved portion 410 of saddle 400, thereby facilitating heat transfer from the saddle to the liquefied gas in the cylinder through the cylinder walls. Once the transportation pallet is secured on the holding device, the fingers of the forklift may be removed from the forklift sleeves of the transportation device.

To remove the cylinder from the heating saddle, the fingers of the forklift may be reinserted into the forklift sleeves of the transportation pallet and the pallet lifted, thereby lifting the cylinder and the pallet from the heating saddle. Therefore, embodiments of the invention allow the heating of ton cylinders without removing the ton cylinders from its respective transportation pallet.

As illustrated in FIG. 4B, heating saddle 400 may include a plurality of taps 450. Taps 450 may provide a heating fluid to a plurality of channels bored into the body of heating saddle 400. When taps 450 are turned on the heating fluid may circulate through the channels, thereby heating the saddle. The saddle, in turn, may transfer heat to the liquefied gas in the cylinder through the cylinder walls. By controlling the temperature of the heating saddle by use of the heating fluid, the temperature of the liquefied gas may also be controlled, thereby controlling the vapor pressure and gas flow rate from the cylinder.

FIGS. 4A and 4C illustrate locations where a plurality of channels 420 may be present within the body of the heating saddle. In one embodiment, as illustrated in FIG. 4A the channels may be bored along the length of the heating saddle. In other embodiments, as illustrated in FIG. 4C, the channels 420 may be bored along the width of heating saddle 400. Some embodiments may include channels bored along both, the width and the length of heating saddle 400, or any other geometric configuration to heat the heating saddle in a desired manner.

In some embodiments, saddle 400 may include a device for moving the heating saddle. For example, the saddle may be equipped with wheels to wheel the saddle in and out of a gas cabinet. However, one skilled in the art will recognize that any reasonable means for moving the saddle, for example, by providing forklift sleeves, may also be used.

One skilled in the art will recognize that the invention is not limited by the design of the transportation pallet and heating saddle described and referenced in FIGS. 3A-3B and 4A-4C. In general, any reasonable design of heating saddles and transportation pallets which allow a transportation pallet containing a ton cylinder to be placed on a heating saddle such that a surface of the ton cylinder is in contact with a surface of the heating saddle to heat the cylinder falls within the scope of the invention.

Figure 5:
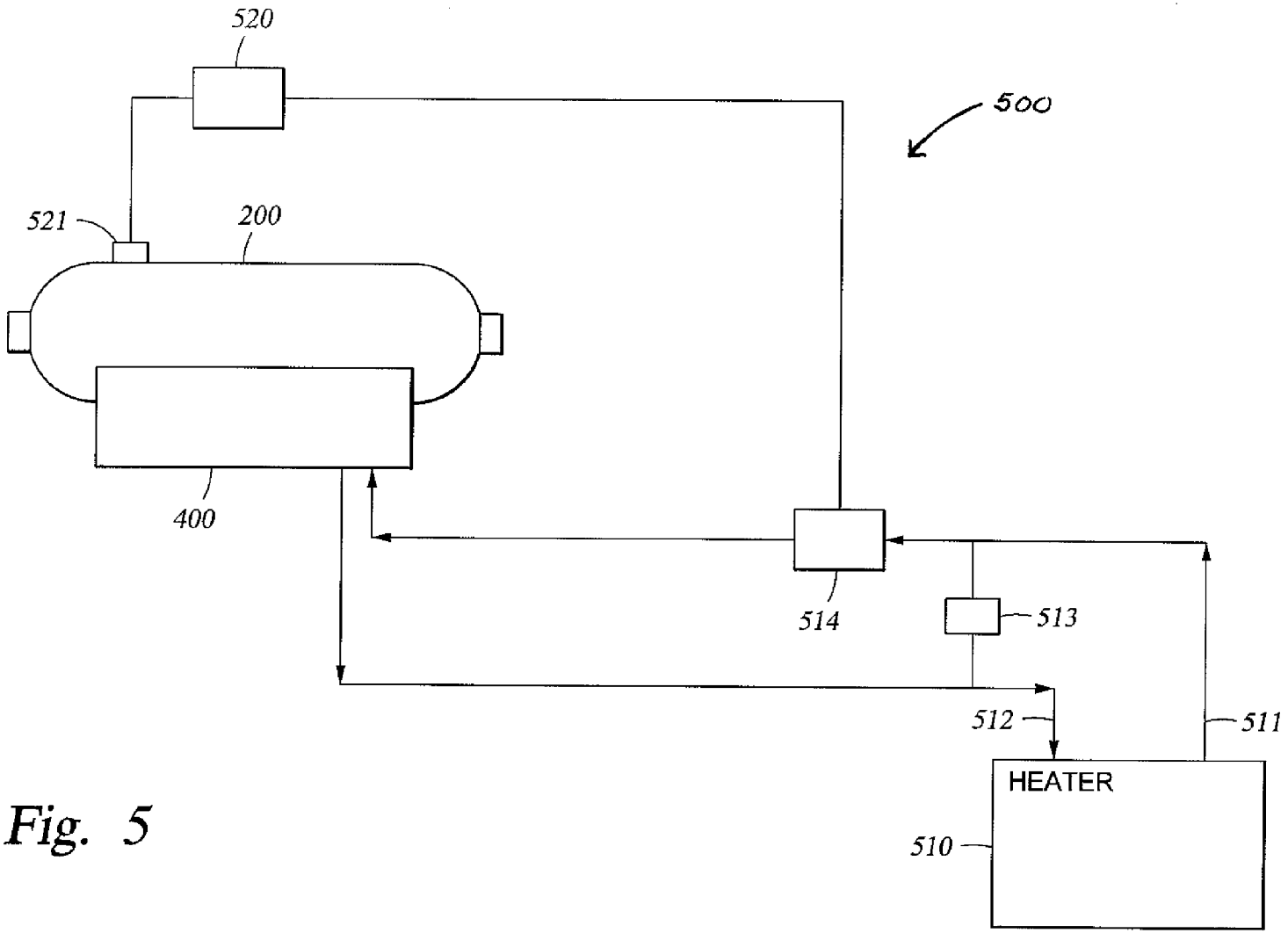
FIG. 5 illustrates an exemplary system for heating a ton cylinder according to an embodiment of the invention.

FIG. 5 illustrates an exemplary system 500 for heating a cylinder 200. As illustrated system 500 may include a heater 510, a heating saddle 400, a pressure controller 520, and a control valve 514. Heater 510 may provide a heating fluid at a determined temperature to saddle 400 through one or more channels. Exemplary heating fluids include water, ethylene glycol solution, heat transfer oils, and the like. The heating fluid may be set at an elevated temperature by heater 510. The pressure of the gas in the cylinder may be continuously monitored and the flow of heating fluid to the heating saddle may be regulated based on the pressure of the gas in the cylinder.

As illustrated in FIG. 5 a forward channel 511 may carry the heating fluid to the heating saddle. The forward channel may connect to a tap 450 of the heating saddle, thereby allowing the heating fluid to flow through the channels bored into the body of the saddle. The heating fluid may circulate through the bored channels of the saddle and return to heater 510 through return channel 512 illustrated in FIG. 5.

As illustrated in FIG. 5, cylinder 200 may include a pressure monitoring device 521 to monitor the vapor pressure of gas in the cylinder. For example, in one embodiment the pressure monitoring device may include a valve configured to release a small quantity gas in the cylinder to measure the vapor pressure. More generally, however, the pressure monitoring device may include any reasonable instrument to provide a reading of vapor pressure in the cylinder.

Pressure controller 520 may read the vapor pressure provided by pressure monitoring device 521, and regulate the flow of heating fluid through the heating saddle to adjust vapor pressure. The vapor pressure of gas in the cylinder may correspond to a temperature of the liquid in the cylinder. For example, as illustrated in FIG. 5, pressure controller 520 may control a pressure control valve 514 connected to forward channel 511. By adjusting the flow of heating fluid through heating saddle 400, the temperature of the heating saddle, and consequently the vapor pressure in cylinder 200 may also be controlled.

For example, heater 510 may provide heating fluid at a constant temperature. If the vapor pressure in the ton cylinder is sufficiently high, pressure controller 520 may close pressure control valve 514 or reduce the flow of heating fluid through pressure control valve 514 because heating of the heating saddle may not be necessary. Closing valve 514 may circulate the heating fluid to the heater through, for example, bypass 513. On the other hand, if the pressure controller determines that the vapor pressure in the cylinder is dropping to an unacceptable level, pressure controller 520 may open pressure control valve 514 to allow the flow of heating fluid to the heating saddle. When a desired temperature of liquid in the cylinder is achieved, the rate at which heating fluid is delivered to the heating saddle may be adjusted by adjusting valve 514 to maintain a constant pressure.

In one embodiment, system 500 may include a bypass valve 513 that connects forward channel 511 to return channel 512. As illustrated bypass valve 513 may shut off flow of heating fluid from heater 510 to saddle 400 by connecting the forward and return channels. The bypass valve may connect the forward and return channel, for example, when heating of the saddle is not required or while disconnecting the cylinder or saddle from the system.

Pressure control valve 514 and bypass valve 513 may be flow control valves that may respond to independent devices such as pressure controller 520, temperature gauges, flow meters, and the like. Valves 513 and 514 may be fitted with actuators that may adjust the flow of gas through a respective gas line based on input from an independent device. Valves 513 and 514 may also permit manual operation of the valves in cases of emergency.

In one embodiment, of the invention, the temperature of the heating fluid may be set to a desired temperature. Therefore, monitoring of the vapor pressure may not be necessary. The heating fluid may continuously flow through the heating saddle elevating and maintaining the temperature of the saddle and the liquefied gas in the cylinder at the desired temperature.

In another embodiment, pressure controller 520 may provide one or more signals directly to heater 510 in response to determining the pressure of gas in the cylinder. Heater 520 may be configured to adjust the temperature of the heating fluid based on the signal received from pressure controller 520.

By allowing ton cylinders to be placed on heating saddles without removing the ton cylinders from their transportation pallets, embodiments of the invention facilitate the safe heating of ton cylinders. Furthermore, by providing a means for monitoring the vapor pressure and adjusting the heating of the cylinder based on vapor pressure in the ton cylinder, the gas flow rates from the ton cylinder may be controlled.

It will be understood that many additional changes in the details, materials, steps, and arrangement of parts, which have been herein described and illustrated in order to explain the nature of the invention, may be made by those skilled in the art within the principle and scope of the invention as expressed in the appended claims. Thus, the present invention is not intended to be limited to the specific embodiments in the examples given above and/or the attached drawings.

What is claimed is:

1. A method for heating a ton cylinder to help control the gas flow rate from the ton cylinder, comprising:

a) placing the ton cylinder along with a transportation pallet for the ton cylinder on a heating saddle, wherein a surface of the ton cylinder makes contact with a surface of the heating saddle; and b) circulating a heating fluid through one or more channels in the heating saddle wherein the heating fluid heats the saddle and the heated heating saddle heats a liquified gas in the ton cylinder through the surface of the ton cylinder in contact with the surface of the heating saddle.

2. The method of claim 1, further comprising:

c) monitoring the vapor pressure of gas in the ton cylinder; and d) adjusting the flow of the heating liquid through the channels of the heating saddle based on the vapor pressure of the gas in the ton cylinder.

3. The method of claim 1, wherein the temperature of the heating fluid is set to a predetermined temperature, wherein the predetermined temperature establishes a desired gas flow rate from the ton cylinder.

4. The method of claim 1, wherein placing the ton cylinder and the transportation pallet for the ton cylinder on the heating saddle comprises matching one or more locating features of the transportation pallet with one or more locating features of the heating saddle to position the ton cylinder in a predetermined desired position on the heating saddle.

5. The method of claim 1, wherein the heating fluid comprises one of:

i) water;

ii) ethylene glycol solution; and iii) heat transfer oil.

6. A heating saddle, comprising:

a) a surface for receiving a ton cylinder, wherein the surface makes contact with a surface of the ton cylinder, the ton cylinder being secured to a transportation pallet associated with the ton cylinder;

b) one or more channels in the body of the heating saddle for circulating a heating fluid to heat the heating saddle; and c) one or more taps, wherein the taps provide an interface between the channels and a heater configured to provide the heating fluids to the heating saddle.

7. The heating saddle of claim 6, further comprising:

d) a holding device wherein the holding device provides support for the transportation pallet containing the ton cylinder; and e) one or more locating features, wherein the locating features of the heating saddle are configured to position the cylinder in a predetermined position on the saddle.

8. The heating saddle of claim 6, wherein the heating saddle is made from steel.

9. The heating saddle of claim 6, wherein the heating fluid comprises one of:

i) water;

ii) ethylene glycol solution; and iii) heat transfer oil.

10. The heating saddle of claim 6, wherein the one or more taps receive the heating fluid from the heater and circulate the heating fluid through the channels to heat the saddle.

11. The heating saddle of claim 6, wherein the heating fluid is returned to the heater after the heating fluid circulates through the channels.

12. A system for heating a ton cylinder, comprising:

a) a heating saddle comprising:

i) a surface for receiving a ton cylinder, wherein the surface makes contact with a surface of a ton cylinder, the ton cylinder being secured to a transportation pallet associated with the ton cylinder; and ii) one or more channels in the body of the heating saddle for circulating a heating fluid, wherein the heating fluid heats the heating saddle; and iii) one or more taps, wherein the taps provide an interface for receiving the heating liquid;

b) a heater suitable for heating the heating fluid; and c) a control valve for controlling the flow of heating fluid from the heater to the heating saddle.

13. The system of claim 12, further comprising a pressure controller configured to determine the vapor pressure of gas in the ton cylinder and adjust the control valve, wherein adjusting the control valve adjusts the flow of heating fluid to the heating saddle.

14. The system of claim 12, wherein the heater is configured to set the temperature of the heating fluid to a predetermined temperature, wherein the predetermined temperature establishes a desired gas flow rate from the ton cylinder.

15. The system of claim 12, wherein the heating fluid comprises one of:

i) water;

ii) ethylene glycol solution; and iii) heat transfer oil.

16. The system of claim 12, wherein the heating saddle further comprises:

iv) a holding device wherein the holding device provides support for the transportation pallet containing the ton cylinder; and v) one or more locating features, wherein the locating features of the heating saddle are configured to position the cylinder in a predetermined position on the saddle.

17. The system of claim 12, wherein the heating saddle is made from steel.

18. The system of claim 12, wherein the one or more taps receive the heating fluid from the heater and circulate the heating fluid through the channels to heat the saddle.

19. The system of claim 12, wherein the heating fluid is returned to the heater after the heating fluid circulates through the channels.

* * * * *